United States Patent [19]

Feldman et al.

[11] 4,210,424

[45] Jul. 1, 1980

[54] COMBINATION OF ETHYLENE POLYMER, NORMAL PARAFFINIC WAX AND NITROGEN CONTAINING COMPOUND (STABILIZED, IF DESIRED, WITH ONE OR MORE COMPATIBILITY ADDITIVES) TO IMPROVE COLD FLOW PROPERTIES OF DISTILLATE FUEL OILS

[75] Inventors: Nicholas Feldman, Woodbridge; Jack Ryer, East Brunswick; Martin F. Dooley, Edison, all of N.J.

[73] Assignee: Exxon Research & Engineering Co., Florham Park, N.J.

[21] Appl. No.: 957,568

[22] Filed: Nov. 3, 1978

[51] Int. Cl.[2] ..... C10L 1/22

[52] U.S. Cl. ..... 44/62; 44/66; 44/71; 44/70

[58] Field of Search ..... 44/62, 70, 71, 66; 208/17, 15

[56] References Cited

U.S. PATENT DOCUMENTS

| | | | |
|---|---|---|---|
| 3,444,082 | 5/1969 | Kautsky | 252/51.5 |
| 3,620,696 | 11/1971 | Hollyday, Jr. et al. | 44/62 |
| 3,640,691 | 2/1972 | Ilnychyj et al. | 44/62 |
| 3,846,093 | 11/1974 | Feldman | 44/62 |
| 3,910,776 | 10/1975 | Feldman | 44/62 |
| 3,982,909 | 9/1976 | Hollyday, Jr. | 44/71 |

FOREIGN PATENT DOCUMENTS 1469016 3/1977 United Kingdom .

*Primary Examiner*—Robert V. Hines
*Assistant Examiner*—J. V. Howard
*Attorney, Agent, or Firm*—Roland A. Dexter; Frank T. Johmann

[57] ABSTRACT

Oil-soluble combinations of (A) ethylene polymer or copolymer, (B) normal paraffinic wax composed of normal hydrocarbons whose average molecular weight is within the range of from 300 to 650, and (C) nitrogen compounds, such as amides, amine salts and ammonium salts, of carboxylic acids or anhydrides, are useful in improving the cold flow properties of distillate hydrocarbon fuel oils. Preferably, the wax contains n-paraffins ranging from $C_{23}$ to $C_{37}$ inclusive. If desired, the combination can be usefully stabilized by the addition of one or more compatibility additives, i.e. a polymer having alkyl side chains of 6 to 30 carbon atoms and derived from carboxylic acid esters and/or olefins or $C_8$–$C_{18}$ alkanol, e.g. tridecyl alcohol or mixtures of said polymer and alkanol.

18 Claims, No Drawings

COMBINATION OF ETHYLENE POLYMER, NORMAL PARAFFINIC WAX AND NITROGEN CONTAINING COMPOUND (STABILIZED, IF DESIRED, WITH ONE OR MORE COMPATIBILITY ADDITIVES) TO IMPROVE COLD FLOW PROPERTIES OF DISTILLATE FUEL OILS

BACKGROUND OF THE INVENTION

1. Field of the Invention

The invention relates to a three (or more) component additive combination for distillate fuel oils, comprising (A) an ethylene backbone distillate fuel oil pour depressant polymer, (B) a normal paraffin wax composed of normal hydrocarbons whose average molecular weight is within the range of from 300 to 650, and (C) a nitrogen compound e.g. amides and salts of a carboxylic acid or anhydride. This combination is particularly useful in distillate fuel oils for improving its cold flow properties by controlling the size of wax crystals that form below the cloud point and inhibiting the agglomeration of these wax crystals.

2. Description of the Prior Art

Two-component additive systems for treating distillate fuel oil to limit the size of wax crystals that form in the fuel oil in cold weather are known, as shown by the following patents.

United Kingdom Pat. No. 1,469,016 teaches ethylene polymer or copolymer, which is a pour depressant for middle distillate fuel, in combination with a second polymer having alkyl groups of 6 to 18 carbon atoms, which is a polymer of an olefin or unsaturated dicarboxylic acid ester, is useful in improving the cold flow properties of middle distillate fuel oils.

U.S. Pat. No. 3,982,909 teaches nitrogen compounds such as amides, diamides, and ammonium salts of: monoamides or monoesters of dicarboxylic acids, alone or in combination with a hydrocarbon microcrystalline wax and/or a pour point depressant, particularly an ethylene backbone polymeric pour point depressant, are wax crystal modifiers and cold flow improvers for middle distillate fuel oils, particularly diesel fuel.

U.S. Pat. Nos. 3,444,082 and 3,846,093 teach various amides and salts of alkenyl succinic anhydride reacted with amines, in combination with ethylene copolymer pour point depressants, for distillate fueis.

U.S. Pat. No. 3,620,696 teaches that the flow and pumpability at low temperatures of middle distillate petroleum fuel oil is made more responsive to the addition of an ethylene copolymeric flow improver by the presence of from about 0.03 to 2 weight percent of normal paraffin hydrocarbons whose average molecular weight is within the range of from 300 to 650.

THE INVENTION

The present invention is based on finding that a 3-component additive system comprising an ethylene containing polymer, normal paraffins whose average molecular weight is within the range of from 300 to 650, and certain nitrogen compounds have advantages over combinations consisting of any two of said additives, in improving cold flow performance of distillate hydrocarbon oils, particularly when the oil is transported through flow lines and pumps, as for example when attempting to feed the fuel into the combustion chamber of a diesel powered prime mover or into a burner. The combination also appears to have utility in the slowing of the gravity settling of wax crystals which occur when the fuel is stored in bulk during very cold weather.

The 3-component additive system of the invention can be usefully stabilized by incorporation of one or more compatibility additives which are of the class consisting of (1) a polymer of an unsaturated carboxylic acid ester and/or olefins, having straight chain alkyl groups of 6 to 30, preferably 12 to 20 carbon atoms, (2) a $C_8$–$C_{18}$ alkanol, e.g. tridecyl alcohol and (3) mixtures of said polymer and said alkanol.

In accordance with the present invention, a fuel composition is provided which comprises distillate fuel oil and from about 0.001 to 2.5 wt.%, e.g. 0.01 to 0.5 wt.%, of a flow and filterability improving, multicomponent additive composition comprising: (A) one part by weight of oil-soluble ethylene backbone distillate flow improving polymer; (B) 0.1 to 30, preferably 0.5 to 15 parts by weight of a normal paraffinic wax composed of normal hydrocarbons whose average molecular weight is within the range of from 300 to 650; preferably normal paraffins ranging from $C_{23}$ to $C_{37}$ inclusive; and (C) 0.01 to 10, e.g. 0.2 to 5 parts by weight of a nitrogen compound which may be amides and/or amine salts of carboxylic acids or ammonium salts of said acids or anhydrides thereof. If desired to enhance the compatibility, i.e. reduce its tendency to disperse into multiple phases, of said multicomponent additive composition from 0.02 to 2 parts by weight, based on the weight of said oil-soluble ethylene backbone distillate flow improving polymer of an auxiliary compatibility additive of the class consisting of (1) a second oil-soluble polymer of an unsaturated carboxylic acid ester and/or olefins having straight chain alkyl groups of 6 to 30 carbons, (2) a $C_8$–$C_{18}$ alkanol and (3) mixtures thereof is admixed with the fuel composition or concentrate containing said additive composition. Concentrates of 20 to 90 wt.% mineral oil and 80 to 10 wt.% of the additive mixture of (A), (B) and (C), dissolved therein, will generally be made for ease of handling the additives.

MULTICOMPONENT ADDITIVES

A. The Ethylene Polymers, Their Derivatives and Copolymers

The ethylene polymers are of the type known in the art as wax crystal modifiers, e.g. pour depressants and cold flow improvers for distillate fuel oils. These polymers will have a polymethylene backbone which is divided into segments by hydrocarbon or oxyhydrocarbon side chains, or by alicyclic or heterocyclic structures or by chlorine atoms. They may be simply homopolymers of ethylene as prepared by free radical polymerization so as to result in some branching. More usually, they will comprise about 3 to 40, preferably 4 to 20, molar proportions of ethylene per molar proportion of a second ethylenically unsaturated monomer, which latter monomer can be a single monomer or a mixture of such monomers in any proportion. These polymers will generally have a number average molecular weight in the range of about 500 to 50,000, preferably about 800 to about 20,000, e.g., 1000 to 6000, as measured for example by Vapor Pressure Osmometry (VPO), such as using a Mechrolab Vapor Pressure Osmometer Model 302B.

The unsaturated monomers, copolymerizable with ethylene, include unsaturated mono and diesters of the general formula:

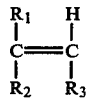

wherein $R_1$ is hydrogen or methyl; $R_2$ is a —$OOCR_4$ or —$COOR_4$ group wherein $R_4$ is hydrogen or a $C_1$ to $C_{28}$, more usually $C_1$ to $C_{16}$, and preferably a $C_1$ to $C_8$, straight or branched chain alkyl group; and $R_3$ is hydrogen or —$COOR_4$. The monomer, when $R_1$ and $R_3$ are hydrogen and $R_2$ is —$OOCR_4$, includes vinyl alcohol esters of $C_1$ to $C_{29}$, more usually $C_1$ to $C_{17}$, monocarboxylic acid, and preferably $C_2$ to $C_5$ monocarboxylic acid. Examples of such esters include vinyl acetate, vinyl isobutyrate, vinyl laurate, vinyl myristate, vinyl palmitate, etc. When $R_2$ is —$COOR_4$ and $R_3$ is hydrogen, such esters include methyl acrylate, isobutyl acrylate, methyl methacrylate, lauryl acrylate, $C_{13}$ Oxo alcohol esters of methacrylic acid, etc. Examples of monomers where $R_1$ is hydrogen and either or both of $R_2$ and $R_3$ are —$COOR_4$ groups, include mono and diesters of unsaturated dicarboxylic acids such as: mono $C_{13}$ Oxo fumarate, di-$C_{13}$ Oxo fumarate, diisopropyl maleate, dilauryl fumarate, ethyl methyl fumarate, etc. It is preferred, however, that the acid groups be completely esterified as free acid groups tend to promote haze if moisture is present in the oil.

Another class of monomers that can be copolymerized with ethylene include $C_3$ to $C_{16}$ alpha monoolefins, which can be either branched or unbranched, such as propylene, isobutene, n-octene-1, isooctene-1, n-decene-1, dodecene-1, etc.

Still other monomers include vinyl chloride, although essentially the same result can be obtained preferentially by chlorinating polyethylene, e.g., to a chlorine content of about 10 to 35 wt.%. Or, as previously mentioned, branched polyethylene can be used per se as the pour depressant.

Also included among the ethylene polymers are the hydrogenated polybutadiene flow improvers having mainly 1,4 addition with some 1,2 addition since they can be considered as being made up of ethylene segments.

The preferred ethylene copolymers can be formed as follows: solvent, and 5–50 wt.% of the total amount of monomer charge other than ethylene are charged to a stainless steel pressure vessel which is equipped with a stirrer and a heat exchanger. The temperature of the pressure vessel is then brought to the desired reaction temperature by passing steam through the heat exchanger, e.g. 70° to 200° C., and pressured to the desired pressure with ethylene, e.g. 700 to 25,000 psig, usually 900 to 7,000 psig. The initiator, usually as a concentrate in solvent (usually the same solvent as used in the reaction) so that it can be pumped and additional amounts of the monomer charge other than ethylene, e.g. the vinyl ester, can be added to the vessel continuously, or at least periodically, during the reaction time. Also during this reaction time, as ethylene is consumed in the polymerization reaction, additional ethylene is supplied through a pressure controlling regulator so as to maintain the desired reaction pressure fairly constant at all times. The constant temperature in the reactor is maintained with the aid of the heat exchanger. Following the completion of the reaction, usually a total reaction time of ¼ to 10 hours will suffice, the liquid phase is discharged from the reactor and solvent and other volatile constituents of the reaction mixtures are stripped off leaving the copolymer as residue. To facilitate handling and later oil blending, the polymer is generally dissolved in a mineral oil preferably an aromatic solvent, such as heavy aromatic naphtha, to form a concentrate usually containing 10 to 60 wt.% of copolymer.

Usually, based upon 100 parts by weight of copolymer to be produced, about 50 to 1200, preferably 100 to 600 parts by weight of solvent, usually a hydrocarbon solvent such as benzene, hexane, cyclohexane; or other suitable solvents, e.g. t-butyl alcohol, etc., and about 1 to 20 part by weight of initiator will be used.

The initiator is chosen from a class of compounds which at elevated temperatures undergo a breakdown yielding radicals, such as peroxide or azo-type initiators, including the acyl peroxides of $C_2$ to $C_{18}$ branched or unbranched carboxylic acids, as well as other common initiators. Specific examples of such initiators include dibenzoyl peroxide, ditertiary butyl peroxide, t-butyl perbenzoate, t-butyl peroctanoate, t-butyl hydroperoxide, alpha, alpha', azo-diisobutyronitrile, dilauroyl peroxide, etc. Choice of the initiator, e.g. peroxide, is governed primarily by the desired polymerization conditions, desired structure of the polymer and the efficiency of the initiator. Considering all these factors, tert.-butyl peroctanotate, dilauroyl peroxide and di-t.-butyl peroxide were found to be preferred, but not exclusive initiators.

Mixtures of these ethylene copolymers can also be used. Thus, U.S. Pat. No. 3,916,916 teaches that improved results can be obtained using a mixture of two ethylene copolymers with different solubilities so that one serves primarily as a nucleator to seed the growth of wax crystals, while the more soluble ethylene copolymer serves as a wax crystal growth arrestor to inhibit the growth of the wax crystals as they are formed.

B. Normal Paraffinic Wax

The paraffin wax that is used in accordance with the invention can consist of normal paraffins ranging from as low as $C_{20}H_{42}$ up to an average of about $C_{45}H_{92}$, with individual n-paraffins in the mixture ranging as high as 50 to 60 carbon atoms. Preferably the number average molecular weight of the wax should be in the range of about 350 to 450. While it is possible to use individual paraffin hydrocarbons in practicing the invention, better results are usually obtained with a wax comprising a mixture of hydrocarbons. Furthermore, it is ordinarily not economic to employ individual normal paraffin hydrocarbons in the wax range.

Particularly effective wax mixtures for distillate fuel oils having final boiling points in the range of 620° to 670° F. are those that have normal paraffin hydrocarbons in the range of $C_{24}$ to $C_{39}$ inclusive. The waxes that are added include both well-defined waxes and crude waxes, such as slack wax and slop wax, as well as any of the various refinery streams wherein wax is a predominant constituent. The waxes that are used have a heat of fusion of from 40 to 55 calories per gram and are thus distinguished from petroleum resins, asphaltenes, petrolatums, and microcrystalline waxes, all of which have heats of fusion below 40 calories per gram. Suitable waxes for use in this invention can be obtained by conventional dewaxing of various paraffinic petroleum refinery streams boiling within the range of about 340° C. to about 565° C.

Particularly useful are the slack waxes obtained from the solvent pressing of oils having a boiling range of from about 345° C. to 500° C.

It is evident that the practice of this invention results in adding to the fuel oil small percentages of normal paraffin hydrocarbons of higher molecular weight than are present initially. Thus a typical heating oil having an atmospheric distillation final boiling point of 350° C. will contain n-paraffins from about $C_{12}$ to about $C_{24}$, with very little $C_{25}$ and higher n-paraffins. The wax which separates from this fuel oil when it is cooled to and below its cloud point will contain this spread of normal paraffins. To improve the low-temperature response of this fuel oil to the additive composition of the invention, a paraffin wax can be used that contains $C_{20}$ and higher n-paraffins, with the average in the range of $C_{24}$ to $C_{32}$.

C. The Nitrogen Containing Compound

Nitrogen compounds effective in keeping the wax crystals separate from each other, i.e. by inhibiting agglomeration of wax crystals, are used as the third component of the additive mixtures. These compounds include oil-soluble amine salts and/or amides, which will be generally formed by reaction of at least one molar proportion hydrocarbyl substituted amines with a molar proportion of hydrocarbyl acid having 1 to 4 carboxylic acid groups or their anhydrides.

In the case of polycarboxylic acids, or anhydrides thereof, all acid groups may be converted to amine salts or amides, or part of the acid groups may be converted to esters by reaction with hydrocarbyl alcohols, or part of the acid groups may be left unreacted.

The hydrocarbyl groups of the preceding amine, carboxylic acid or anhydride, and alcohol compounds include groups which may be straight or branched chain, saturated or unsaturated, aliphatic, cycloaliphatic, aryl, alkaryl, etc. Said hydrocarbyl groups may contain other groups, or atoms, e.g. hydroxy groups, carbonyl groups, ester groups, or oxygen, or sulfur, or chlorine atoms, etc. These hydrocarbyl groups will usually be long chain, e.g. $C_{12}$ to $C_{40}$, e.g. $C_{14}$ to $C_{24}$. However, some short chains, e.g. $C_1$ to $C_{11}$ may be included as long as the total numbers of carbons is sufficient for solubility. Thus, the resulting compound should contain a sufficient hydrocarbon content so as to be oil-soluble and it will therefore normally contain in the range of about 30 to 300, e.g. 36 to 160 total carbon atoms. The number of carbon atoms necessary to confer oil solubility will vary with the degree of polarity of the compound. In general, about 36 or more carbons are preferred for each amide linkage that is present in the compound, while for the more polar amine salts about 72 carbons or more are preferred for each amine salt group. The compound will preferably also have at least one straight chain alkyl segment extending from the compound containing 8 to 40, e.g. 12 to 30 carbon atoms. This straight chain alkyl segment may be in one or several of the amine or ammonium ion, or in the acid, or in the alcohol (if an ester group is also present). At least one ammonium salt, or amine salt, or amide linkage is required to be present in the molecule.

The amines may be primary, secondary, tertiary or quaternary, but preferably are secondary. If amides are to be made, then primary or secondary amines will be used.

Examples of primary amines include n-dodecyl amine, n-tridecyl amine, $C_{13}$ oxo amine, coco amine, tallow amine, behenyl amine, etc. Examples of secondary amines include methyl-lauryl amine, dodecyl-octyl amine, coco-methyl amine, tallow-methylamine, methyl-n-octyl amine, methyl-n-dodecyl amine, methyl-behenyl amine, ditallow amine, etc. Examples of tertiary amines include coco-diethyl amine, cyclohexyl-diethyl amine, coco-dimethyl amine, tri-n-octyl amine, di-methyl-dodecyl amine, methyl-ethyl-coco amine, methyl cetyl stearyl amine, etc. Examples of quaternary amino bases or salts include dimethyl dicetyl amino base, dimethyl distearyl amino chloride, etc.

Amine mixtures may also be used and many amines derived from natural materials are mixtures. Thus, coco amines derived from coconut oil are a mixture of primary amines with straight chain alkyl groups ranging from $C_8$ to $C_{18}$. Another example is tallow amine, derived from hydrogenated tallow acids, which amine is a mixture of $C_{14}$ to $C_{18}$ straight chain alkyl groups, e.g. typically 3% $C_{14}H_{29}$, 34% $C_{16}H_{33}$ and 63% $C_{18}H_{37}$. Tallow amine is particularly preferred.

Examples of the carboxylic acids or anhydrides, include formic, acetic, hexanoic, lauric, myristic, palmitic, hydroxy stearic, behenic, naphthenic, salicyclic, acrylic, linoleic, dilinoleic, trilinoleic, maleic, maleic anhydride, fumaric, succinic, succinic anhydride, alkenyl succinic anhydride, adipic, glutaric, sebacic, lactic, malic, malonic, citraconic, phthalic acids (o, m, or p), e.g. terephthalic, phthalic anhydride, citric, gluconic, tartaric, 9,10-di-hydroxystearic, etc.

Specific examples of alcohols include 1-tetradecanol, 1-hexadecanol, 1-octadecanol, $C_{12}$ to $C_{18}$ Oxo alcohols made from a mixture of cracked wax olefins, 1-hexadecanol, 1-octadecanol, behenyl alcohol, 1,2-dihydroxy octadecane, 1,10-dihydroxydecane, etc.

The amides can be formed in a conventional manner by heating a primary or secondary amine with acid, or acid anhydride. Similarly, the ester is prepared in a conventional manner by heating the alcohol and the polycarboxylic acid to partially esterify the acid or anhydride (so that one or more carboxylic groups remain for the reaction with the amine to form the amide or amine salt). The ammonium salts are also conventionally prepared by simply mixing the amine (or ammonium hydroxide) with the acid or acid anhydride, or the partial ester of a polycarboxylic acid, or partial amide of a polycarboxylic acid, with stirring, generally with mild heating (e.g. 70°-80° C.)

Particularly preferred are nitrogen compounds of the above type that are prepared from dicarboxylic acids, optimally the aliphatic dicarboxylic acids. Mixed amine salts/amides are most preferred, and these can be prepared by heating maleic anhydride, or alkenyl succinic anhydride with a secondary amine, preferably tallow amine, at a mild temperature, e.g. 80° C. without the removal of water.

AUXILIARY COMPATIBILITY ADDITIVES

1. The Second Oil-Soluble Polymer of Ester and/or Olefins

These oil-soluble ester and/or higher olefin polymers will generally have a number average molecular weight in the range of about 1000 to 200,000, e.g. 1,000 to 100,000, preferably 1000 to 50,000, as measured, for example, by Vapor Pressure Osmometry such as by a Mechrolab Vapor Pressure Osmometer, or by Gel Permeation Chromatography. These second polymers include (a) polymers, both homopolymers and copolymers of unsaturated alkyl ester, including copolymers with other unsaturated monomers, e.g. olefins other than ethylene, nitrogen-containing monomers, etc. and (b) homopolymers and copolymers of olefins, other than ethylene.

At least about 10 wt.%, preferably at least 25 wt.%, and frequently 50 wt.% or more of the polymer will be in the form of straight chain $C_6$ to $C_{30}$, e.g. $C_8$ to $C_{24}$, e.g. $C_8$ to $C_{16}$ alkyl groups of an alpha olefin or an ester, for example, the alkyl portion of an alcohol used to esterify a mono or dicarboxylic acid, or anhydride. To illustrate, using a $C_{16}$ straight chain alkyl acrylate as the source of the aforesaid straight chain alkyl group, one could have a homopolymer of n-hexadecyl acrylate. Or one could have a copolymer of said n-hexadecyl acrylate with a short chain monomer, e.g. a copolymer of n-hexadecyl acrylate with methylacrylate. Or one could have n-hexadecyl acrylate copolymerized with docosanyl acrylate. Or, one could have a terpolymer of methyl acrylate, n-hexadecyl acrylate, and $C_{30}$ branched chain alkyl acrylate. Or the n-hexadecyl acrylate could be copolymerized with an unsaturated ester other than that derived from acrylic acid, such other ester having its unsaturation either in the acid part or the alcohol part of the molecule, etc.

Among the esters which can be used to make these polymers, including homopolymers and copolymers of two or more monomers, are ethylenically unsaturated, mono- and diesters represented by the formula:

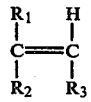

wherein $R_1$ is hydrogen or $C_1$ to $C_6$ hydrocarbyl, preferably alkyl groups, e.g. methyl; $R_2$ is a —$OOCR_4$ or —$COOR_4$ group wherein $R_4$ is hydrogen or a $C_1$ to $C_{30}$, e.g. $C_1$ to $C_{24}$ straight or branched chain hydrocarbyl, e.g. alkyl group; and $R_3$ is hydrogen or —$COOR_4$. The short chain monomers, i.e. those of less than 6 carbons in the alkyl group, will be used as comonomers with the desired long chain monomers, i.e. 6 or more carbons in the alkyl group. The long chain monomers can be used either to make polymers only of long chain monomers, or copolymers with short chain monomers. The monomer, when $R_1$ and $R_3$ are hydrogens and $R_2$ is —$OOCR_4$ includes vinyl alcohol esters of monocarboxylic acids. Examples of such esters include short alkyl chain monomers (used to make copolymers such as vinyl acetate and vinyl propionate. Long chain monomers include vinyl laurate, vinyl myristate, vinyl palmitate, vinyl behenate, vinyl tricosanate, etc. When $R_2$ is —$COOR_4$, examples of such esters include short chain monomers such as methyl acrylate, methyl methacrylate, and isobutyl acrylate, as well as long chain monomers such as lauryl acrylate, $C_{13}$ Oxo alcohol esters of methacrylic acid, behenyl acrylate, behenyl methacrylate, tricosanyl acrylate, etc. Examples of monomers where $R_1$ is hydrogen and $R_2$ and $R_3$ are both —$COOR_4$ groups, include: mono and diesters of unsaturated dicarboxylic acids such as short alkyl chain monomers, e.g., mono-isopropyl maleate and diisopropyl fumarate, as well as long alkyl chain monomers such as mono $C_{13}$ Oxo fumarate, di-$C_{13}$ Oxo maleate, dieicosyl fumarate, lauryl-hexyl fumarate, didocosyl fumarate, dieicosyl citraconate, di(tricosyl) fumarate, and dipentacosyl citraconate. As earlier indicated, fully esterified esters are preferred in order to reduce haze problems with oils containing moisture.

In addition, minor molar amounts, e.g. 0 to 20 mole %, e.g. 0.1 to 10 mole %, nitrogen-containing monomers can be copolymerized into the polymer, along with the foregoing monomers. These nitrogen-containing monomers include those represented by the formula:

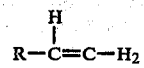

wherein R is a 5- or 6-membered heterocyclic nitrogen-containing ring which can contain one or more substituent hydrocarbon groups. In the above formula, the vinyl radical can be attached to the nitrogen or to a carbon atom in the radical R. Examples of such vinyl derivatives include 2-vinyl pyridine, 4-vinyl pyridine, 2-methyl-2-vinyl pyridine, 2-ethyl-5-vinyl pyridine, 4-methyl-5-vinyl pyridine, N-vinyl pyrrolidone, 4-vinyl pyrrolidone and the like.

Other monomers that can be included are the unsaturated amides such as those of the formula:

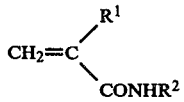

wherein $R^1$ is hydrogen or methyl, and $R^2$ is hydrogen or an alkyl radical or alkenyl radical having up to about 24 carbon atoms. Such amides are obtained by reacting acrylic acid or a low molecular weight acrylic ester with an amine such as butylamine, hexylamine, tetrapropylene, amine, cetylamine, ethanolamine and tertiary-alkyl primary amines.

Preferred ester polymers for the present purpose, from the point of view of availability and cost, are copolymers of vinyl acetate and dialkyl fumarate in about equimolar proportions, and also the polymers, including copolymers, of acrylic esters or methacrylic esters. The alcohols used to prepare the fumarate and said acrylic and methacrylic ester are usually monohydric, saturated, straight chain primary aliphatic alcohols containing from 4, e.g. 6 to 30 carbon atoms in the molecule. These esters need not be pure, but may be prepared from technical grade mixtures.

Any mixtures of two or more polymers of the esters set forth herein can also be used. These may be simple mixtures of such polymer, or they may be copolymers which can be prepared by polymerizing a mixture of two or more of the monomeric esters. Mixed esters derived by the reaction of a single or mixed acids with a mixture of alcohols, etc. may be used.

The ester polymers are generally prepared by polymerizing the ester monomers in a solution of a hydrocarbon solvent such as heptane, benzene, cyclohexane, or white oil, at a temperature generally in the range of from 60° C. to 250° C. and usually promoted with a free radical initiator, e.g. a peroxide or azo-type initiator, e.g. benzoyl peroxide, under a blanket of refluxing solvent or an inert gas such as nitrogen or carbon dioxide in order to exclude oxygen.

The unsaturated carboxylic acid ester can also be copolymerized with an olefin. If a dicarboxylic acid anhydride is used, e.g. maleic anhydride, it can be polymerized with the olefin and then esterified with alcohol. To further illustrate, the ethylenically unsaturated carboxylic acid or derivative thereof is reacted with an olefin, such as $C_8$–$C_{32}$, preferably $C_{10}$–$C_{26}$ olefin, usually an alpha olefin, by mixing the olefin and acid, e.g. maleic anhydride, usually in about equimolar amounts, and heating to a temperature of at least 80° C., preferably at least 125° C. A free radical polymerization promoter such as di-lauroyl peroxide, t-butyl hydroperoxide or di-t-butyl peroxide, is normally used. The resulting copolymer thus prepared is then esterified with alcohol. Copolymers of maleic anhydride with styrene, or cracked wax olefins, which copolymers are then completely esterified with alcohol are other examples of the olefin-ester polymer.

Another useful class of said second polymer are olefin polymers, which can be either homopolymers and copolymers of long chain $C_8$ to $C_{32}$, preferably $C_{10}$ to $C_{26}$, aliphatic alpha-monoolefin or copolymers of said long chain alpha-monoolefins with shorter chain $C_3$ to $C_7$ aliphatic alpha-olefins or with styrene or its derivatives, e.g. copolymers comprising 20 to 90 wt.% of said $C_8$ to $C_{32}$ alpha-olefin and 80 to 10 wt.% of said $C_3$ to $C_7$ aliphatic monoolefin, or styrene-type olefin.

Examples of such monomers include short chain monomers such as propylene, butene-1, hexene-1; and long chain monomers such as octene-1, decene-1, 3-methyl decene-1, tetradecene-1, hexadecene-1, octadecene-1, etc. Examples of styrene-type olefins include styrene and styrene derivatives such as p-methyl styrene, p-isopropyl styrene, alphamethyl styrene, etc.

These olefin polymers may be conveniently prepared by polymerizing the monomers under relatively mild conditions of temperature and pressure in the presence of a Friedel-Crafts type catalyst, e.g. $AlCl_3$, which will give an irregular polymer, or Ziegler-Natta type of an organometallic catalyst, i.e. a mixture of a compound derived from a Group IV, V or VI metal of the Periodic Table in combination with an organometallic compound of a Group I, II or III metal of the Periodic Table, wherein the amount of the compound derived from a Group IV–VI metal may range from 0.01 to 2.0 moles per mole of the organometallic compound.

Examples of the Ziegler-Natta type catalysts include the following combinations: aluminum triisobutyl and vanadium trichloride; aluminum triisobutyl, aluminum chloride, and vanadium trichloride; vanadium tetrachloride and aluminum trihexyl; vanadium trichloride and aluminum trihexyl; vanadium triacetyl-acetonate and aluminum diethyl chloride; titanium tetrachloride and aluminum trihexyl; vanadium trichloride and aluminum trihexyl; titanium trichloride and aluminum trihexyl; titanium dichloride and aluminum trihexyl, etc.

The polymerization is usually carried out by mixing the catalyst components in an inert diluent such as a hydrocarbon solvent, e.g. hexane, benzene, toluene, xylene, heptane, etc., and then adding the monomers into the catalyst mixture at atmospheric or superatmospheric pressures and temperatures within the range between about 0° to 120° C., preferably 35° to 85° C. Usually atmospheric pressure is employed when polymerizing monomers containing more than 4 carbon atoms in the molecule and elevated pressures are used if the more volatile $C_3$ or $C_4$ alpha-olefins are present. The time of reaction will depend upon, and is interrelated to, the temperature of the reaction, the choice of catalyst, and the pressure employed. In general, however, ½ to 5 hours will complete the reaction.

Various polymers of the above types are available as lubricating oil pour point depressants, and such lubricating oil pour point depressants have been found to be effective as an auxiliary stabilizing additive to be added to the multicomponent additive combinations of the invention.

2. Alkanols

The $C_8$ to $C_{18}$, preferably $C_{13}$, alkanols useful as an auxiliary compatibility additive are in general commercially available aliphatic alcohols which can be straight or branched chain. Among these alcohols useful in preparing said flushing combination are hexanol, heptanol, octanol, 2-ethyl hexanol, etc., through octadecanol with the preferred alcohol being tridecyl alcohol. A highly suitable source of alcohols are the Oxo alcohols which are prepared in a two-stage reaction. The first stage of the Oxo process involves reacting olefins, such as polymers and copolymers of $C_3$ and $C_4$ monoolefins, with carbon monoxide and hydrogen at temperatures about 150° to 200° C. and pressures of about 30 to 400, atmospheres in the presence of a suitable catalyst to form a mixture of aldehydes having one carbon atom more than the olefin. In the second stage, the aldehyde mixture is hydrogenated to form an isomeric mixture of highly branched chain primary alcohols which is recovered by distillation. Particularly suitable as an auxiliary compatibility additive for this invention is tridecyl Oxo alcohol.

When used in combination with the second polymer the $C_8$ to $C_{18}$ alkanols are preferably used in an amount of from about 0.5 to 10, preferably 1 to 5 parts by weight per part by weight of said second polymer of ester and/or olefins.

The Distillate Fuels

The distillate fuel oils will generally boil within the range of about 120° C. to about 425° C., e.g. 150 to about 355° C. The fuel oil can comprise atmospheric distillate or vacuum distillate, or cracked gas oil or a blend in any proportion of straight run and thermally and/or catalytically cracked distillates, etc. The most common petroleum distillate fuels are kerosene, jet fuels, diesel fuels and heating oils. The heating oil may be a straight atmospheric distillate, or it may frequently contain minor to large amounts e.g. 0 to 85 wt.%, of vacuum gas oil and/or of cracked distillates. The low temperature flow problem is most usually encountered with diesel fuels and with heating oils.

Of recent years, there has also been a tendency to increase the final boiling point (FBP) of distillates so as to maximize the yield of fuels. These fuels, however, include longer chain n-paraffins and generally will have higher cloud points. This, in turn, will usually mean that wax crystals become even more of a problem in cold weather by aggravating the difficulties encountered with oil movement due to the plugging by wax of pipelines, screens, filters, meters, etc.

The final composition of the invention will generally comprise a major amount of the distillate fuel and about 0.001 to 2.5 wt.%, preferably 0.01 to 0.5, wt.% of the aforedescribed oil-soluble ethylene containing flow improvers; about 0.005 to 2.0, preferably 0.05 to 0.5, wt.% of the aforesaid normal paraffin wax, and from about 0.001 to 0.5, preferably 0.005 to 0.10, wt.% of the aforementioned oil-soluble nitrogen compound; wherein said weight percents are based on the weight of the total composition.

Oil-soluble, as used herein, means that the additives are soluble in the fuel at ambient temperatures, e.g., at least to the extent of about 0.01 wt.% additive in the fuel oil at 25° C., although at least some of the additive comes out of solution near the cloud point in order to modify the wax crystals that form.

The invention will be further understood by reference to the following Examples which include preferred embodiments of the invention.

Example 1

In carrying out this Example, the following additive materials were used:

Polymer 1

Polymer 1 used in this Example, was a concentrate in about 55 wt.% of heavy aromatic naphtha oil and about 45 wt.% of an ethylene-vinyl acetate copolymer of ethylene and about 38 wt.% vinyl acetate, and had a number average molecular weight of about 1800 (VPO). It is identified in said U.S. Pat. No. 3,916,916 as Copolymer B of Example I (column 8, lines 25–35).

Nitrogen Compound A

This compound was prepared in accordance with U.S. Pat. No. 3,982,909 and is an amine salt of the monoamide of maleic anhydride. It was prepared by reacting one mole of maleic anhydride with two moles of secondary hydrogenated tallow amine (about 505 mol. wt.) at a temperature such that no water is formed.

The secondary hydrogenated tallow amine, derived from tallow fat is a commercially available product sold by Armak Co., Chemicals Division, Chicago, Ill. and designated Armeen 2HT. The reaction mixture was removed and the solvent distilled. The product, a maleamic acid amine salt, has a melting point of 64° C.

Nitrogen Compound B

Nitrogen Compound B was a diamide of maleic anhydride and said secondary hydrogenated amine formed by reacting one mole of maleic anhydride with two moles of said Armeen 2HT with heating in a solvent to a temperature sufficient to remove all the water and thereby form the diamide.

Slack Wax

This slack wax is obtained from the dewaxing of a refinery stream having a boiling range of 345° C. to 500° C. This slack wax contained about 6.1 wt.% Solvent Neutral 150 oil, had a specific gravity (°API) of 0.8488, was a waxy solid, an average molecular weight by Gel Permeation Chromotographic Analysis (GPC) of 435, contained about 76.1 wt.% n-paraffins ranging from 19 to 37 carbons but primarily 22 to 34 carbons with an average carbon number of 27. The n-paraffin distribution was as follows: $C_{19}$=0.19%; $C_{20}$=0.39%; $C_{21}$=0.67%; $C_{22}$=1.4%; $C_{23}$=2.9%; $C_{24}$=6.3%; $C_{25}$=8.4%; $C_{26}$=10.6%; $C_{27}$=9.6%; $C_{28}$=9.1%; $C_{29}$=7.9%; $C_{30}$=6.5%; $C_{31}$=5.0%; $C_{32}$=3.8%; $C_{33}$=1.8%; $C_{34}$=1.2%; $C_{35}$=0.42%; $C_{36}$=0.22%; and, $C_{37}$=0.12%.

Foots Oil

The foots oil used herein was obtained as a distillation stream of an oil fraction boiling between 370° C. to 522° C. intermediate of the turbine lubricating oil stream and the residua containing slack wax. The foots oil is a wax solid containing 48.6 wt.% oil, has a specific gravity (°API) of 0.8853, an average molecular weight (GPC) of non-oil portion of 484, 2.35 wt.% content of n-paraffins ranging from 19 to 28, predominantly 22 to 28, carbons and average carbon number of 24.9. The balance of the non-oil portion was believed to be iso- and cycloparaffins of 23 to 39 carbons.

Heavy Aromatic Naphtha (HAN)

This is a useful solvent for the n-paraffins used in accordance with this invention as well as the multicomponent additives of the invention and typically has an aniline point of 24.6° C., a specific gravity (°API) of 0.933, a boiling range of 179° C. to 235° C. and is composed of 4 wt.% paraffins, 6.7 wt.% naphthenes, 87.3 wt.% aromatics, e.g. polyalkyl aromatics, and 2.0 wt.% olefins.

THE TEST OILS

The distillate fuel oils used in the test blends had:

| | Oil 1 | Oil 2 |
|---|---|---|
| Cloud Point (ASTM D-2500) | −3° C. | −10° C. |
| ISP | 158° C. | 158° C. |
| 50% dist. | 265° C. | — |
| Final Boiling Point | 352° C. | 336° C. |

TESTS USED TO EVALUATE THE INVENTION

The utility of this invention in enhancing the cold flow properties of middle distillate fuel oils is demonstrated by the Cold Filter Plugging Point (CFPP) Test and a test determinative of the minimum screen through which the oil blend will pass at a temperature 3° C. below the cloud point of the distillate fuel oil. Also shown are the effect the additive combination has on the cold flow of bottom fractions subjected to wax settling.

THE COLD FILTER PLUGGING POINT (CFPP) TEST

This test is carried out by the general procedure described in "Journal of the Institute of Petroleum," Volume 52, Number 510, June 1966 pp. 173–185. In brief, a 40 ml. sample of the oil to be tested is cooled in a specially designed tester, by a bath maintained at about −34° C. Periodically (at each one degree Centigrade drop in temperature starting at least from 2° C. above the cloud point of the oil) the cooled oil is tested for its ability to flow through a fine screen in a time period using a test device which is a pipette to whose lower end is attached an inverted funnel which is positioned below the surface of the oil to be tested. Stretched across the mouth of the funnel is a 350 mesh screen having a diameter of 12 mm. The periodic tests are each initiated by applying a vacuum of about 8" of water to the upper end of the pipette whereby oil is drawn through the screen up into the pipette to a mark indicating 20 ml. of oil. The test is repeated with each one degree drop in oil temperature until the oil fails to fill the pipette within 60 seconds. The results of the test are reported as the temperature (the plugging point) in °C. at which the oils fail to fill the pipette in the prescribed time of one minute.

Imperial Cold Filterability (ICF) Test 200 ml. of each test oil blend was cooled from 0° C. at the rate of 1° C./hr. to the test temperature −6° C. which was 3° C. below the cloud point of the fuel. At this temperature, the test blends were allowed to flow through various test screens under a vacuum of 200 mm. of water to determine the finest mesh size through which at least 90% of the test oil blend would pass within 25 seconds.

Modified CFPP Test

In this modified test, the test oil blend was soaked at 6° C. below its cloud point, i.e. at −9° C., for 24 hours. After this soak period, the bottom 10% fraction was removed and allowed to warm up to room temperature and remain therefor at least 3 hours. These bottom fractions were then subjected to the CFPP test. This test gives an indication of the degree of deterioration in the cold flow property of a bottom fraction due to wax settling.

Oil Blends 1 to 6 were made up by dissolving the additives into the Oil 1 by stirring, generally while warming the oil on a hot plate to about 60° C. The polymer additive was added in the form of an oil concentrate containing 45 wt.% polymer and the nitrogen compound A plus slack wax was added to the oil directly. Oil blends A through H were made up by dissolving the respective additives into Oil 2 by stirring, generally while warming the oil on a hot plate to about 60° C. The additives were added in the same form as those used in test blends 1 through 6.

The results of the tests are set forth in the following Table wherein test blends 1 through 6 show the results of the CFPP Test, the ICF Test and the modified CFPP Test whereas test oil blends A through H show only the results of the CFPP Test.

TABLE I

| Test Blend | Polymer | Nitrogen Compound A | Slack Wax | CFPP Test °C. | ICF Test finest screen for pass | Modified CFPP Test °C. |
|---|---|---|---|---|---|---|
| Oil 1 | 0 | 0 | 0 | −4 | fails 20 mesh | — |
| 1 | 0.036 | 0 | 0 | −8 | 20 mesh | +6 |
| 2 | 0.018 | 0.02 | 0 | −6 | 60 mesh | +6 |
| 3 | 0.018 | 0 | 0.21 | −11 | 100 mesh | +3 |
| 4 | 0.018 | 0.02 | 0.21 | −14 | 325 mesh | −7 |
| 5 | 0 | 0.04 | 0.21 | 0 | 60 mesh | — |
| 6 | 0.018 | 0 | 0.28 | −11 | 100 mesh | +3 |
| Oil 2 | 0 | 0 | 0 | −11 | — | — |
| A | 0.1 | 0 | 0 | −12 | — | — |
| B | 0.2 | 0 | 0 | −13 | — | — |
| C | 0.5 | 0 | 0 | −17 | — | — |
| D | 0.06 | 0 | 0.4 | −14 | — | — |
| E | 0.08 | 0 | 0.4 | −17 | — | — |
| F | 0.4 | 0.1 | 0 | −17 | — | — |
| G | 0.04 | 0.01 | 0.4 | −20 | — | — |
| H | 0.05 | 0.015 | 0.4 | −21 | — | — |

The data of Table I shows that the presence of n-paraffins of carbon number ranging from 23 to 37 in combination with an ethylene-vinyl acetate type flow improver and a maleic anhydride amine reaction product in a middle distillate fuel provides it with better low temperature flow properties than would be obtained by treatment of the fuel with any of these individually or with the dual combination of any two of the three types even at higher concentration. In addition, using the three-component combination listed above has an inhibiting effect on the rate of wax settling of the flow improved fuel. Wax settling, which can take place in most flow improved fuels, can cause a severe deterioration in the flow properties of the bottom fraction of a fuel stored at temperatures below the cloud point.

EXAMPLE 2

Since fuel additives are conventionally sold as concentrates in solvent, it is useful under certain circumstances to provide the concentrates in a stable, i.e. single phase, fluid form so they can be readily incorporated into the distillate fuel which is to be treated to improve its cold flow properties. This is normally done by blending in from 50 to 500, preferably 100 to 300 wt.% diluent such as heavy aromatic naphtha. Unfortunately, such a dilution oftentimes results in phase separation into two or more discrete phases.

A typical package according to this invention is

| Additive | Wt. % Range | Preferred Wt. % |
|---|---|---|
| Polymer 1 | 5–15 | 8–12 |
| Nitrogen Compound | 5–15 | 8–12 |
| Slack Wax | 10–30 | 15–25 |
| Diluent | 50–75 | 55–65 |

which varies from being a waxy solid to a highly viscous liquid at room temperature. Unfortunately, if some of the above formulations are diluted with up to 90 to 110%, e.g. 100% diluent, phase separation frequently occurs. This can be overcome by the addition of the auxiliary compatibility additives as seen from the following data. For example, the additive formulations all of which are waxy solids at room temperature as follows undergo phase separation when diluted with an equal volume of heavy aromatic naphtha.

| Additive | Concentrate 1 | Concentrate 2 | Concentrate 3 |
|---|---|---|---|
| Polymer 1 | 15.3 | 15.3 | 15.3 |
| Nitrogen Compound B | 17 | 17 | 17 |
| Slack Wax | — | — | 31.9 |
| Foots Oil | 34 | — | |
| Coray Wax | — | 30 | — |
| Diluent (HAN and oil) | 33.7 | 27 | 21 |

Adding 1 wt.% of Acryloid 954 (a 45 wt.% mineral oil solution of methacrylate polymer sold by Rohm and Haas of Philadelphia, Pa.) and from 2 to 10 wt.% of (Oxo)tridecyl alcohol by simply melting and stirring in the latter components provides a stable system i.e. single phase when diluted with 1 to 5 preferably 1 to 3 volumes of diluent such as HAN as seen from the following:

| Ingredient | Package A Wt. % | A' | B Wt. % | B' |
|---|---|---|---|---|
| Concentrate 1 | 48.5 | 44.5 | — | — |
| Concentrate 2 | — | — | 21.8 | 48.5 |
| Concentrate 3 | — | — | — | — |
| Acryloid 954 | 0.5 | 0.5 | 0.25 | 0.5 |
| (Oxo) tridecyl alcohol | 1 | 5 | 0.5 | 1 |
| HAN | 50 | 50 | 75 | 50 |
| Condition of Package | stable liquid | stable liquid | stable liquid | [1]not stable (6% solids separated) |

[1]on centrifuging 8% solids drop out

Analysis of Acryloid 954 indicated it comprises principally alkyl methacrylate moieties and the alcohol used to make the methacrylate moieties comprises about 75 wt. % of isodecyl alcohol ($C_{10}$ Oxo alcohol) and about 25 wt. % of a linear primary $C_{12}$ to $C_{18}$ alcohol mixture which analyzed about 4% $C_{12}$; about 5% $C_{13}$; about 3% $C_{14}$; about 10% $C_{10}$ and about 2% $C_{18}$ with a trace of $C_{20}$. The product is sold as a lubricating oil multifunctional additive having V.I., pour point depressing and dispersancy properties. Analysis also indicated that it contained nitrogen.

In summary then, the additive formulations containing the high average molecular weight n-paraffinic, isoparaffinic and cycloparaffinic waxes of from 300 to 750 along with the oil-soluble ethylene backbone distillate flow improving polymer and said oil-soluble nitrogen compound in amounts ranging from 10 to 50 wt.% package or concentrate, balance solvent and/or diluent can be usefully stabilized with from 1 to 10 weight percent of an auxiliary compatibility additive or mixture of said compatibility additives.

It is to be understood that the Examples present in the foregoing specification are merely illustrative of this invention and are not intended to limit it in any manner; nor is the invention to be limited by any theory regarding its operability. The scope of the invention is to be determined by the appended claims.

What is claimed is:

1. A wax-containing petroleum fuel oil comprising a major proportion of a distillate oil boiling in the range of 120° to 425° C., which fuel oil has been improved in its low temperature flow properties, containing in the range of about 0.001 to 2.5 wt. %, based on the weight of the total composition, of a flow improving combination of:

(A) one part by weight of an oil-soluble ethylene backbone distillate flow improving polymer having a number average molecular weight in the range of about 500 to 50,000;

(B) 0.1 to 30 parts by weight of wax comprising principally n-paraffins having from 20 to 60 carbons; and (C) 0.01 to 10 parts by weight of an oil-soluble nitrogen compound containing a total of about 30 to 300 carbon atoms and having at least one straight chain alkyl segment of 8 to 40 carbons, and selected from the class consisting of amine salts and/or amides of hydrocarbyl carboxylic acids or anhydrides having 1 to 4 carbonyl groups.

2. A fuel oil according to claim 1 wherein said ethylene backbone polymer (A) is selected from the group consisting of branched polyethylene, hydrogenated polybutadiene, chlorinated polyethylene of 10 to 35 wt.% chlorine, and copolymers comprising essentially 3 to 40 molar proportions of ethylene with a molar proportion of a comonomer selected from the group consisting of: $C_3$ to $C_{16}$ alpha monoolefin, vinyl chloride, and ethylenically unsaturated alkyl ester of the formula:

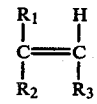

wherein $R_1$ is hydrogen or methyl; $R_2$ is a —$OOCR_4$ or —$COOR_4$ group; $R_4$ is hydrogen or a $C_1$ to $C_{28}$ alkyl group; and $R_3$ is hydrogen or —$COOR_4$, and mixtures of said comonomers.

3. A fuel oil according to claim 2, wherein said n-paraffins are derived from slack wax and are predominantly from 23 to 34 carbons.

4. A fuel oil according to claim 3, wherein said nitrogen compound (C) is an aliphatic $C_4$ dicarboxylic acid or anhydride wherein one of said carboxylic acid groups is reacted with either $C_{12}$ to $C_{30}$ straight chain alcohol or a secondary alkyl monoamine having $C_{12}$ to $C_{30}$ straight chain alkyl groups, to thereby form a monoester or a monoamide, and the other of said carboxylic acid groups is reacted to form an amide or amine salt with a secondary alkyl monoamine having $C_{12}$ to $C_{30}$ straight chain alkyl groups.

5. A fuel oil according to claim 3, wherein said nitrogen compound (C) is a dicarboxylic acid or anhydride reacted with a secondary alkyl monoamine having $C_{12}$ to $C_{30}$ straight chain alkyl groups.

6. A fuel oil composition according to claim 3, wherein said parts by weight of (B) ranges from 0.5 to 15, and said parts by weight of (C) ranges from 0.2 to 5, per parts by weight of (A).

7. A fuel oil composition according to claim 1, wherein said ethylene backbone distillate flow improving polymer (A) is a copolymer of 4 to 20 molar proportions of ethylene per molar proportion of unsaturated ester of the general formula:

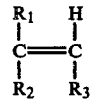

wherein $R_1$ is hydrogen or methyl; $R_2$ is a —$OOCR_4$ or —$COOR_4$ group; wherein $R_3$ is hydrogen or —$COOR_4$; and $R_4$ is hydrogen or a $C_1$ to $C_8$ alkyl group, said copolymer having a number average molecular weight in the range of about 800 to 20,000.

8. A fuel oil composition according to claim 7, wherein said nitrogen compound (C) is a $C_4$ dicarboxylic acid having both of its carboxylic acid groups reacted with secondary alkyl monoamine having alkyl groups essentially of 14 to 18 carbon atoms.

9. A fuel oil composition according to claim 7, wherein said nitrogen compound (C) is maleic anhydride having both of its carboxylic acid groups reacted with secondary alkyl monoamine having alkyl groups essentially of 14 to 18 carbon atoms.

10. A fuel oil composition according to claim 8, wherein said fuel oil is a distillate produced by atmospheric distillation, wherein said ethylene backbone distillate flow improving polymer (A) is a copolymer of ethylene and vinyl acetate and said nitrogen compound (C) is a dialkyl amine salt of maleic monoamide and said alkyl substituents have from 14 to 18 carbons.

11. A fuel oil composition according to claim 8, wherein said fuel oil is a distillate produced by atmospheric distillation, wherein said ethylene backbone distillate flow improver polymer (A) is a copolymer of ethylene and vinyl acetate, and said nitrogen compound (C) is the reaction product of maleic anhydride and hydrogenated secondary tallow amine.

12. An additive concentrate useful for treating distillate fuel oils to improve their cold flow properties comprising about 20 to 90 wt. % of a diluent oil and about 80 to 10 wt. % of an additive combination of:

(A) one part by weight of an oil-soluble ethylene backbone distillate flow improving polymer having a number average molecular weight in the range of about 500 to 50,000;

(B) 0.1 to 30 parts by weight of n-paraffins having from 20 to 60 carbons;

(C) 0.1 to 10 parts by weight of an oil-soluble nitrogen compound containing a total of about 30 to 300 carbon atoms and selected from the class consisting of amine salts and/or amides of a $C_4$ to $C_{30}$ hydrocarbyl carboxylic acid or anhydride having 1 to 4 carbonyl groups, said compound having at least one straight chain alkyl segment of 8 to 40 carbon atoms, having in addition from 0.1 to 10 parts by weight of an auxiliary compatibility agent of the class consisting of a second oil-soluble polymer (D) having a molecular weight in the range of about 1000 to 200,000 wherein at least 10% by weight of said polymer is in the form of straight chain alkyl groups having 6 to 30 carbon atoms, said polymer comprising unsaturated ester and/or olefin moieties, said moieties comprising a major weight proportion of said polymer, a $C_8$ to $C_{18}$ alkanol (E) and mixtures thereof.

13. An additive concentrate according to claim 12, wherein said ethylene distillate flow improving polymer (A) is a copolymer comprising principally 4 to 20 molar proportions of ethylene and a molar proportion of unsaturated ester of the general formula:

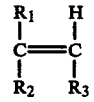

wherein $R_1$ is hydrogen or methyl; $R_2$ is a —$OOCR_4$ or —$COOR_4$ group; $R_3$ is hydrogen or —$COOR_4$; and $R_4$ is hydrogen or a $C_1$ to $C_{28}$ alkyl group, said copolymer having a number average molecular weight in the range of about 800 to 20,000.

14. An additive concentrate according to claim 12 wherein said ethylene backbone distillate flow improving polymer (A) is a copolymer of ethylene and vinyl acetate and said nitrogen compound (C) is a bisamide of maleic anhydride.

15. An additive concentrate according to claim 12 wherein said nitrogen compound (C) is a maleic acid or anhydride reacted with secondary alkyl monoamine having alkyl groups essentially of 14 to 18 carbon atoms.

16. A method for improving a distillate fuel by adding a minor proportion of said additive concentrate of claim 12.

17. An additive concentrate according to claim 12, wherein said ethylene polymer is a copolymer of ethylene and vinyl acetate; said n-paraffins are present in a wax of 300 to 700 molecular weight containing n-paraffinic, isoparaffinic and cycloparaffinic waxes, said nitrogen compound is the reaction product of maleic anhydride and secondary hydrogenated tallow amine and said compatibility agent is a polymer comprising alkyl methacrylate monomers.

18. An additive concentrate according to claim 17, wherein said compatibility agent includes tridecyl alcohol.

* * * * *